US005900390A

United States Patent [19]

Das

[11] Patent Number: 5,900,390

[45] **Date of Patent: *May 4, 1999**

[54] FERROELECTRIC TUNABLE COAXIAL FILTER

[76] Inventor: Satyendranath Das, P.O. Box 574, Mt. View, Calif. 94042-0574

[ * ] Notice: This patent is subject to a terminal disclaimer.

[21] Appl. No.: 08/565,031

[22] Filed: Nov. 30, 1995

Related U.S. Application Data

[62] Division of application No. 08/309,979, Sep. 20, 1994, Pat. No. 5,496,796.

[51] Int. Cl.[6] ..... H01P 1/202; H01B 12/02

[52] U.S. Cl. ..... 505/210; 505/700; 505/701; 505/866; 333/99.005; 333/207

[58] Field of Search ..... 333/995, 206, 333/207; 505/210, 700, 701, 704, 866

[56] References Cited

U.S. PATENT DOCUMENTS 2,510,022 5/1950 Korman et al. ..... 333/207 X 2,577,510 12/1951 Cohn ..... 333/206

5,459,123 10/1995 Das ..... 333/995 X 5,496,796 3/1996 Das ..... 505/210

FOREIGN PATENT DOCUMENTS 1490401 11/1977 United Kingdom ..... 333/207

*Primary Examiner*—Benny T. Lee

[57] ABSTRACT

A coaxial cavity is loaded with a single crystal ferroelectric rod whose permittivity is dependent on the electric field in which it is immersed. Application of a bias voltage changes the permittivity of the ferroelectric rod of the cavity and thus changing the frequency of the coaxial cavity. A tunable coaxial filter is obtained. By placing the cavity in the main transmission line, a bandpass tunable filter is obtained. By placing the cavity in a branch line, a band reject tunable filter is obtained.

19 Claims, 9 Drawing Sheets

FERROELECTRIC TUNABLE COAXIAL FILTER

This application is a division of application Ser. No. 08/309,979, filed Sep. 20, 1994, U.S. Pat. No. 5,496,796.

FIELD OF INVENTION

The present invention relates to tunable filters of electromagnetic waves.

BACKGROUND OF THE STATE OF THE ART

In many field of electronics, it is often necessary to select and to eliminate signal of a frequency band. YIG type tunable filters are available.

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such, the device is small in size. The ferroelectrics are operated in the paraelectric phase, i.e. slightly above the Curie temperature. Inherently they have a broad bandwidth. They have no low frequency limitation as in the case of ferrite devices. The high frequency operation is governed by the relaxation frequency, such as 95 GHz for strontium titanate, of the ferroelectric material. The loss of a ferroelectric tunable filter is low with ferroelectric materials with a low loss tangent. A number of ferroelectric materials are not subject to burnout.

Das discussed the properties of ferroelectric microstrip phase shifters for a two element array. S. Das, "Ferroelectrics for Time Delay Steering of an Array", Ferroelectrics, vol. 5, No. 3/4, 1973.

Depending on trade-off studies in individual cases, the best type of filter can be selected.

SUMMARY OF INVENTION

The general purpose of this invention is to provide low loss tunable filters which embrace the advantage of similarly employed conventional devices such as semiconductor, ferrite, tube and YIG devices.

To attain this, the present invention contemplates the use of an air filled coaxial main transmission line.

It is an object of this invention to provide low loss coaxial tunable filters which are capable of handling high peak and average power levels.

A coaxial cavity is loaded with a ferroelectric rod whose permittivity is dependent on the electric field in which it is immersed. Application of a bias voltage changes the permittivity of the ferroelectric rod of the cavity and thus the frequency of the coaxial cavity. A tunable filter is obtained.

The ferroelectric material could be a ferroelectric liquid crystal (FLC) material or a solid. Candidate ferroelectrics include a mixture of strontium titanate and lead titanate, a mixture of strontium and barium titanate, $KTa_{1-x}Nb_xO_3$ where the value of x is between 0.005 and 0.7, a composition of powdered mixture of strontium titanate and lead titanate and polythene powder, potassium dihydrogen phosphate, triglycine sulphate.

With these and other objectives in view, as will hereinafter be more particularly pointed out in the appended claims reference is now made to the following description take in connection with the accompanying diagrams.

DETAILED DESCRIPTION OF THE PREFERRED EMBODIMENTS

Figure 1:
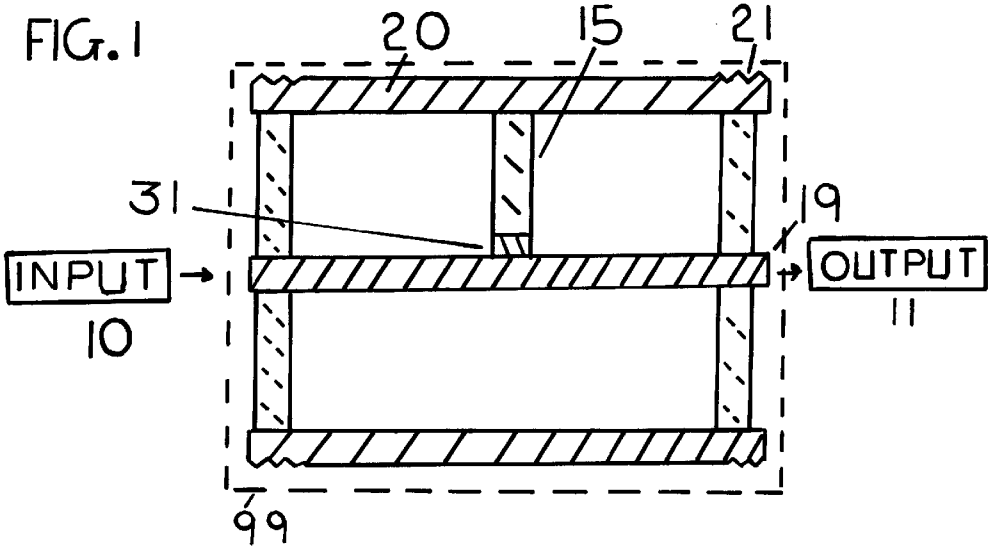
FIG. 1: Longitudinal cross-section through the ferroelectric rod of a coaxial tunable filter.

Referring to the drawings, there is illustrated in FIG. 1, a typical microwave or millimeter wave circuit configuration that incorporates the principles of the present invention. The filter might be a part of a cellular, terrestrial, microwave, satellite, radio determination, radio navigation, radar or other telecommunication system. The filter is operated at a constant temperature slightly above the Curie temperature of the ferroelectric material. Room temperature conductors and, in another embodiment, high Tc superconductors, including YBCO, are used. The means for operating the filter at a constant temperature is 99. It is a Cryocooler for operation at a high superconducting Tc. Candidate ferroelectric materials include $KTa_{1-x}Nb_xO_3$ where the value of x is between 0.005 and 0.7, mixture of strontium titanate and lead titanate, mixture of strontium titanate and barium titanate, a composition of powdered mixture of strontium titanate and lead titanate and polythene powder, a composition of powder polythene and another ferroelectric material, potassium dihydrogen phosphate, triglycine sulphate.

The branch line impedance can be controlled by (1) the ferroelectric material, (2) the diameter of the inner conductor and (3) the diameter of the outer conductor. All these parameters are contemplated in this invention. The conductors are room temperature and, in another embodiment, high Tc superconductors including YBCO, TBCCO. The outer and inner surfaces of the ferroelectric are deposited with conductors, and in another embodiment, with a film of a single crystal high Tc superconductor. For obtaining the best performance, the inner and outer surfaces of the ferroelectric material 15 of FIG. 1 are deposited with a film of a single crystal high Tc superconductor. In the current state of technology, a film of a single crystal high Tc superconductor can be deposited only on selected number of single crystals. The ferroelectric devices have two components of loss: (1) dielectric loss tangent and (2) conductive loss. The dielectric loss is the predominant loss. If the design provides a low dielectric loss ferroelectric material on which a epitaxial film of a high Tc superconductor can not be deposited, then the design is selected to reduce the copper conductive losses without the use of a film of a single crystal high Tc superconductor on the ferroelectric material. Same reference number are used to denote the same element throughout the document.

In FIG. 1 is depicted a coaxial ferroelectric tunable filter. The inner conductor is 19. The outer conductor is 20. A coaxial cavity is formed with two inductive irises. Because of the opening of the irises, they are not visible in FIG. 1. The ferroelectric rod is 15. Input is 10 and the output is 11. Element 21 is a threaded section for connecting a connector.

Figure 2:
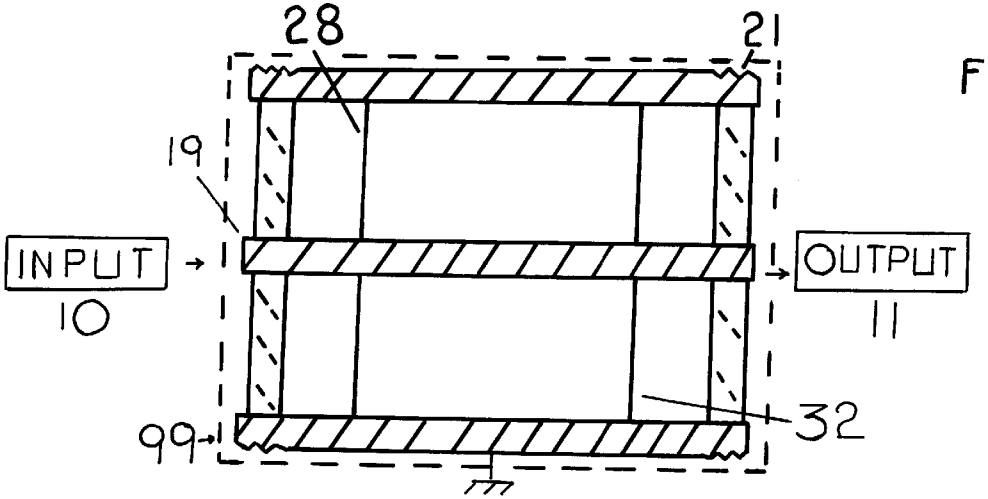
FIG. 2: Longitudinal cross-section, through the iris, of a tunable filter.
Figure 3:
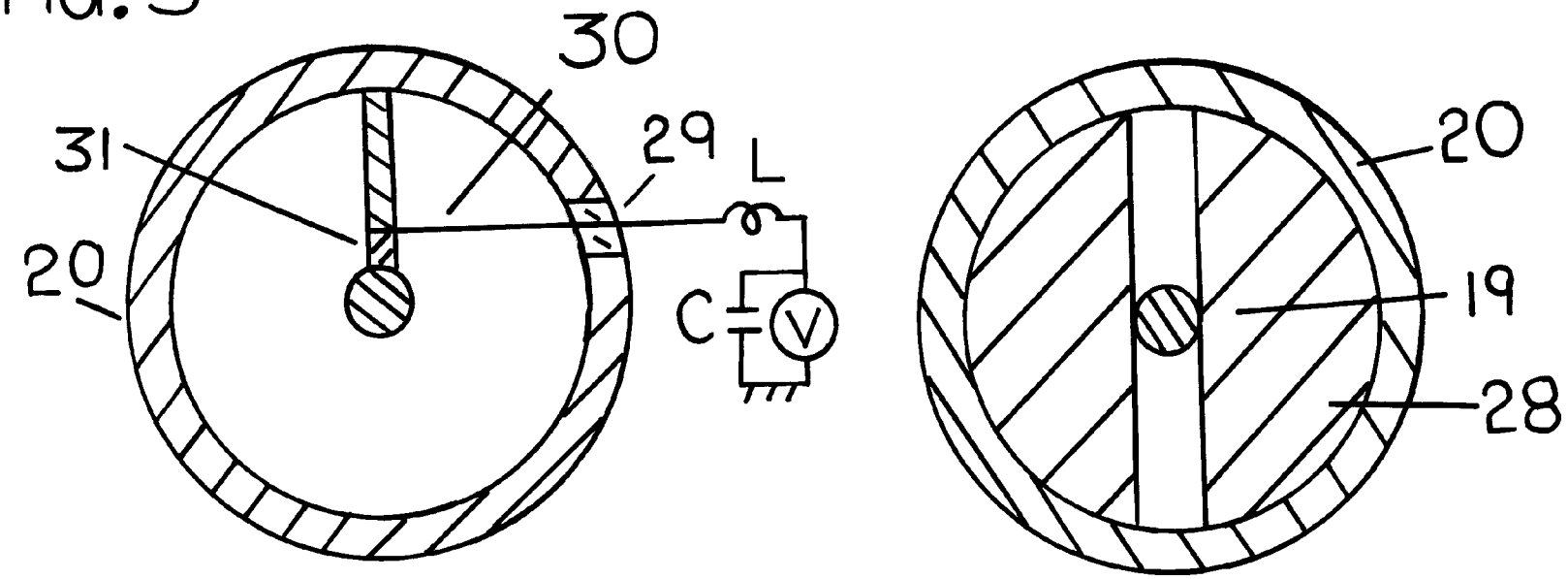
FIG. 3: Transverse cross-sections, through an iris and a bias wire, of a tunable coaxial filter.

In FIG. 2 is depicted the coaxial filter, a cross-section showing the irises. The irises are 28 and 32. The loaded cavity is resonant in the dominant TEM mode. The coaxial cavity acts as a filter. Without any bias applied to the ferroelectric rod 15, the loaded cavity is tuned to the dominant TEM mode. With a bias applied to the ferroelectric rod 15, its permittivity changes. This results in the change of the resonant frequency of the loaded coaxial cavity. The larger the magnitude of the applied bias voltage, the larger is the shift of the resonant frequency of the coaxial cavity and a tunable filter is thus obtained. Element 21 is a threaded section for connecting a connector. in FIG. 3, the inductive iris 28 is shown. The bias wire is 30 passing through an insulator 29. The bias wire is insulated from the inner conductor 19 by an insulator 31. The inductor L provides a large impedance to the RF energy. The capacitor C provides low impedance to any RF energy remaining after the inductance L. The bias voltage is V. The outer conductor is 20.

Figure 4:
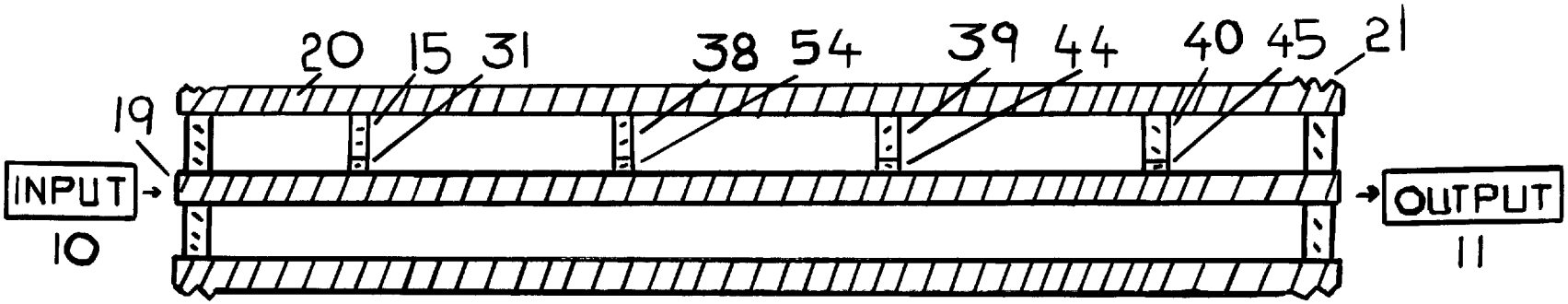
FIG. 4: Longitudinal cross-section, through the ferroelectric rods, of a 4 cavity tunable filter.
Figure 5:
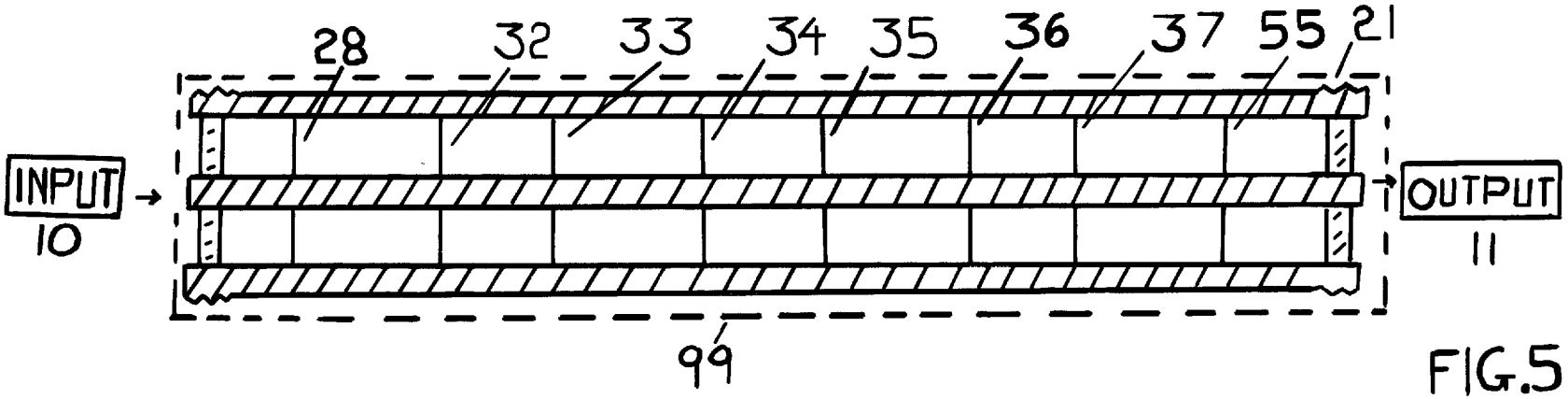
FIG. 5: Longitudinal cross-section, through the irises, of a 4 cavity tunable filter.
Figure 6:
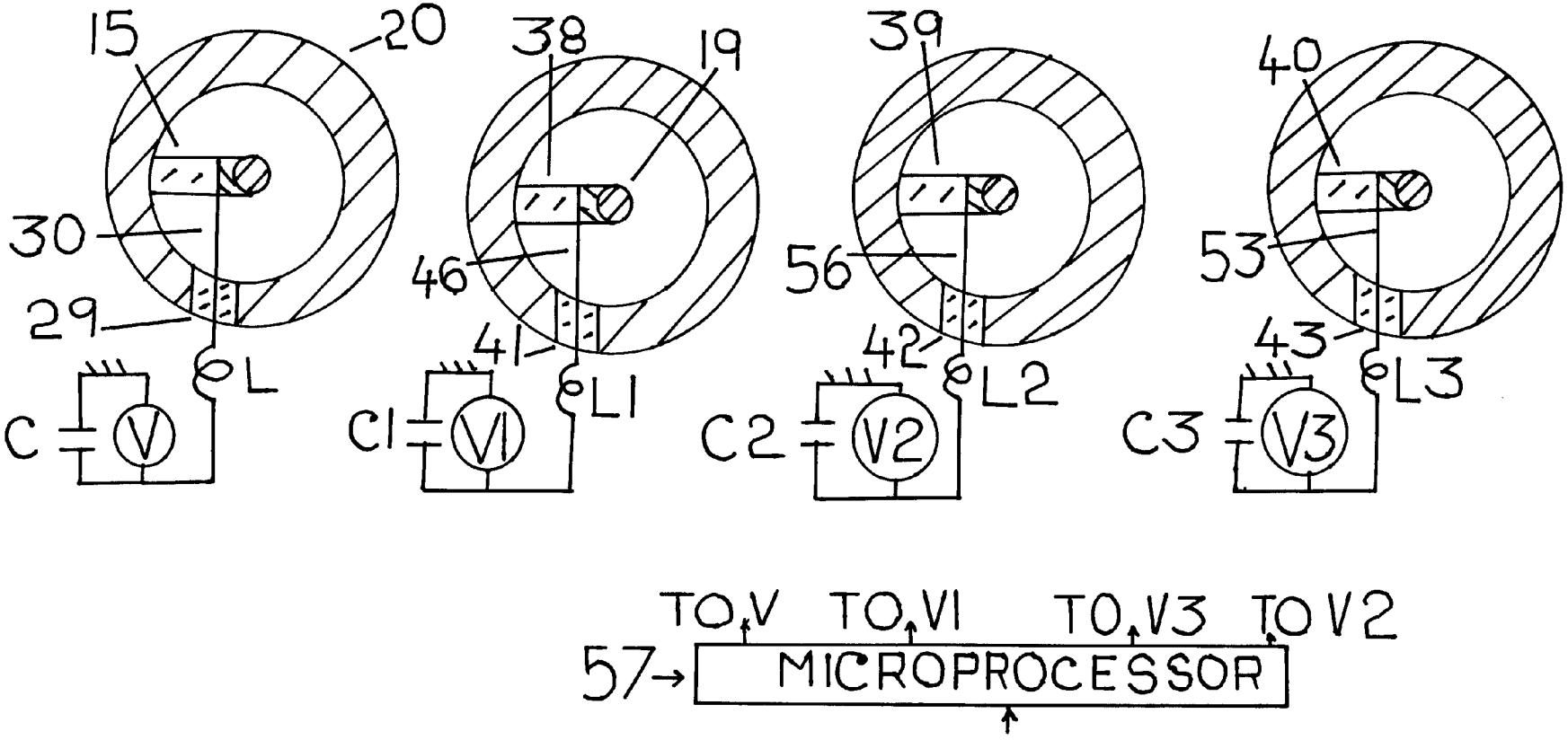
FIG. 6: Transverse cross-sections, through the bias wires, of a 4 cavity tunable filter.

In FIG. 4, FIG. 5 and FIG. 6 is depicted a a 4 cavity coaxial filter. The ferroelectric rods of the 4 cavities are 15, 38, 39 and 40 (see FIG. 4). The inductive irises of the cavities are 28, 32, 33, 34, 35, 36 and 37, 55 (see FIG. 5). The bias wires for the ferroelectric rods are 30, 46, 56 and 53 (see FIG. 6). The bias insulators on the outer conductor 20 are 29, 41, 42 and 43 (see FIG. 6). The bias insulators on the inner conductor 19 are 31, 54, 44 and 45 (see FIG. 4). Each cavity is calibrated with the resonant frequency as a function of the required bias voltage to the ferroelectric rod. The data, for all the four cavities are stored in a memory unit inside the microprocessor 57. On giving a command of a specific resonant frequency, appropriate bias voltages are applied to each cavity. The separation between the cavities is three quarters of a wavelength and, in another embodiment, an appropriate length. For a greater level of attenuation outside the pass band, all four cavities are tuned to the same frequency. To obtain a broad band pass filter, each cavity is staggered tuned from that of the adjacent cavity. In FIG. 6, the bias inductances are L, L1, L2 and L3 and bias capacitances are C, C1, C2 and C3 and the bias voltages are V, V1, V2 and V3, respectively. In each one of FIG. 4 and FIG. 5, input is 10 and the output is 11. The conductors of FIGS. 1–6 are room temperature conductors and, in another embodiment, high Tc superconductors including YBCO and TBCCO. The ends of the ferroelectric rods are deposited with a conductor.

Figure 7:
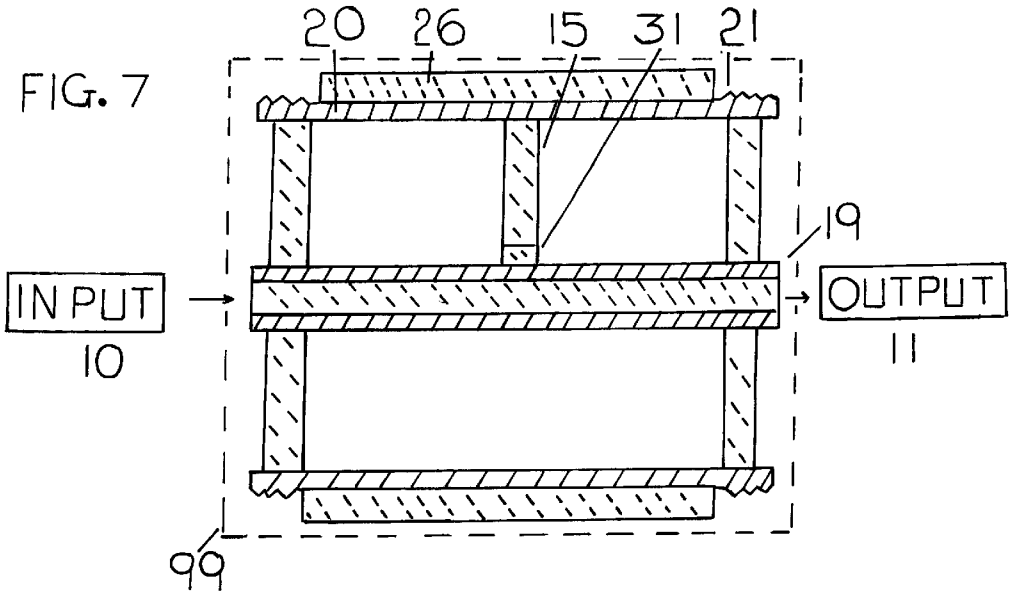
FIG. 7: Cross-section, through the ferroelectric rod, of a single crystal dielectric coaxial tunable filter.
Figure 8:
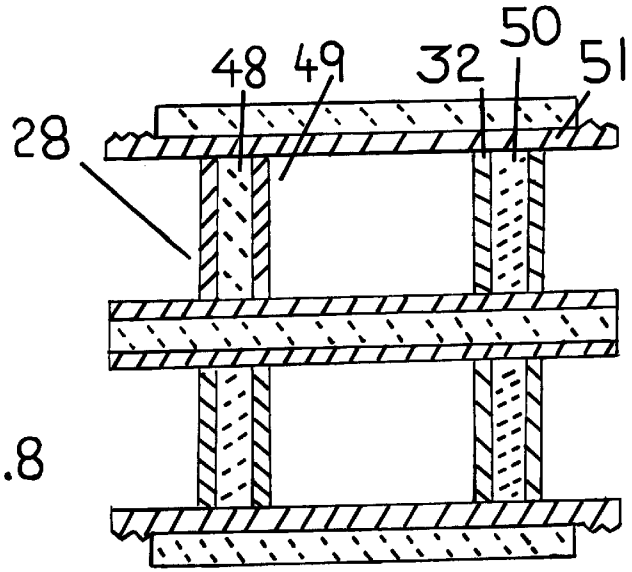
FIG. 8: Longitudinal cross-section, excluding the ferroelectric rod, of a single crystal coaxial tunable filter.
Figure 9:
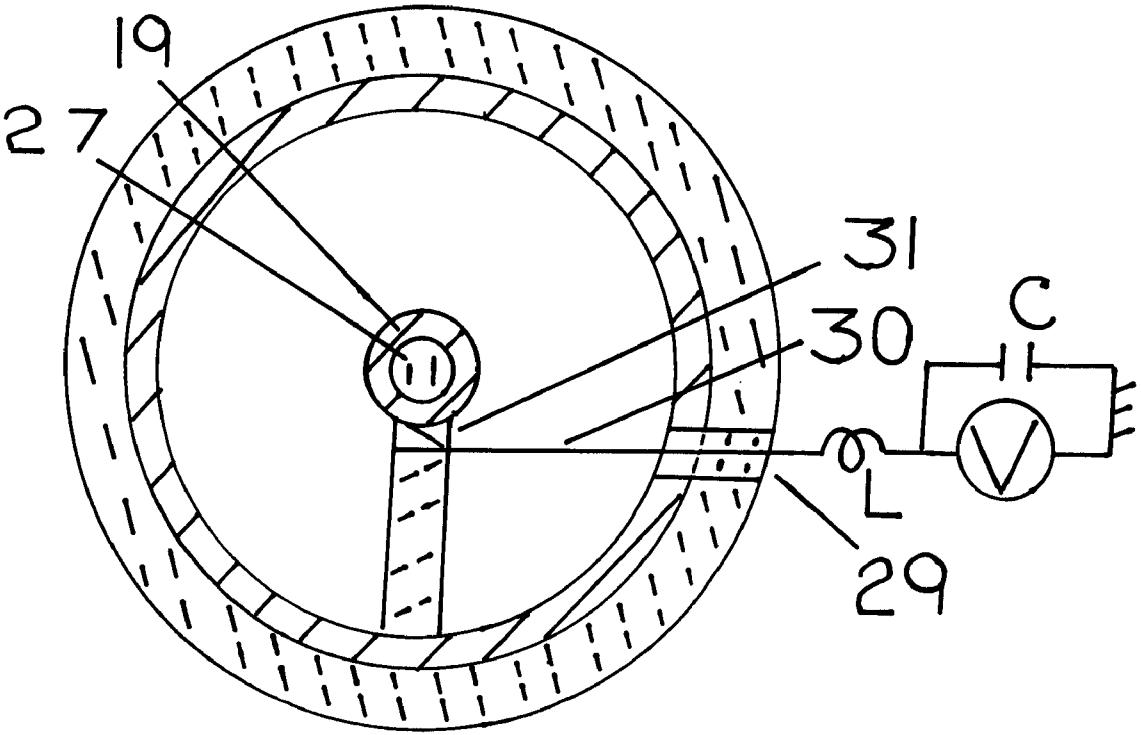
FIG. 9: Cross-section, through the bias wire, of a single crystal dielectric coaxial tunable filter.

In FIG. 7, FIG. 8 and FIG. 9 is depicted a single crystal dielectric coaxial tunable filter. Candidate dielectric materials include sapphire and lanthanum aluminate. The conducting surfaces of the dielectric material are deposited with a film of a single crystal high Tc superconductor including YBCO and TBCCO. The inner dielectric rod is 27. The surfaces 19 of dielectric 27 are deposited with a film of a single crystal high Tc superconductor. The dielectric irises are 48 and 50 (see FIG. 8). The conducting surfaces 28, 49 and 32, 51 of respectively irises 48 and 50 are deposited with a film of single crystal high Tc superconductor. The outer conductor is 20. Element 21 a threaded region for connecting a connector. The bias inductor is L, the bias capacitor is C and the bias voltage is V. Only one dielectric coaxial cavity, the interior conducting surfaces of which are deposited with a film of a single crystal high Tc superconductor, is shown in FIG. 7, FIG. 8 and FIG. 9. Multi cavity coaxial filters, each cavity being of the embodiment of FIG. 7, FIG. 8 and FIG. 9 and with an appropriate separation between the cavities, are included in this invention.

Figure 10:
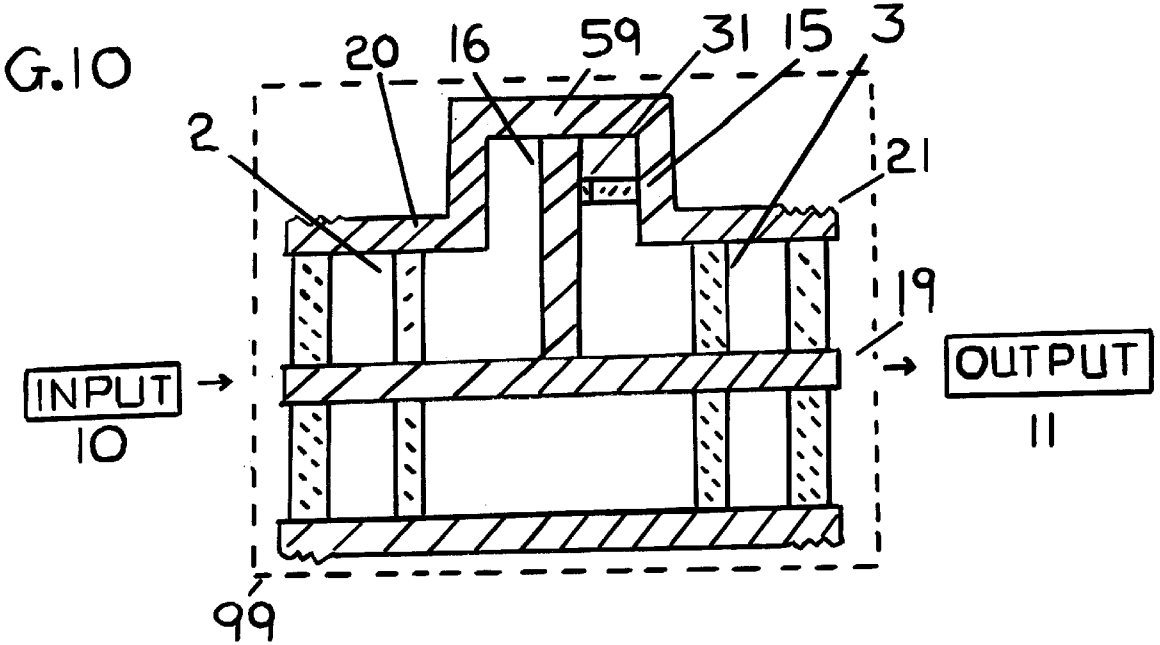
FIG. 10: Longitudinal cross-section, showing the ferroelectric rod, of a band reject tunable filter.
Figure 12:
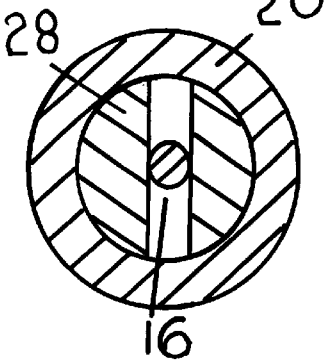
FIG. 12: Cross-section, through the iris, of a cavity band reject tunable filter.
Figure 11:
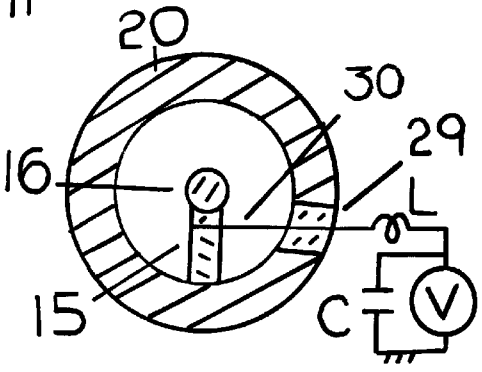
FIG. 11: Cross-section, through the bias wire, of a band reject tunable filter.

In FIG. 10 and FIG. 11 are depicted a band reject tunable filter. The branch line is loaded with a ferroelectric rod 15. The branch line is short circuited by a plate 59 at the end as seen in FIG. 10. The branch line is coupled, by an iris 28 (not visible in FIG. 10), to the main transmission line. The branch line forms a loaded cavity tuned to the dominant TEM mode operating frequency of the band reject filter. The bias wire is 30 and the insulator is 29 as seen in FIG. 11. The center conductor is 19. The outer conductor is 20. The input is 10 and the output is ii. At the resonant frequency of the branch cavity the signal to the output is attenuated. As a bias is applied to the ferroelectric rod 15, its permittivity and consequently the resonant frequency of the cavity are changed. The band reject filter is tuned by the application of a voltage V to the ferroelectric rod. The element 21 is a threaded section for connecting a connector. The bias inductor is L and the bias capacitor is C. FIG. 12 shows the iris 28.

Figure 13:
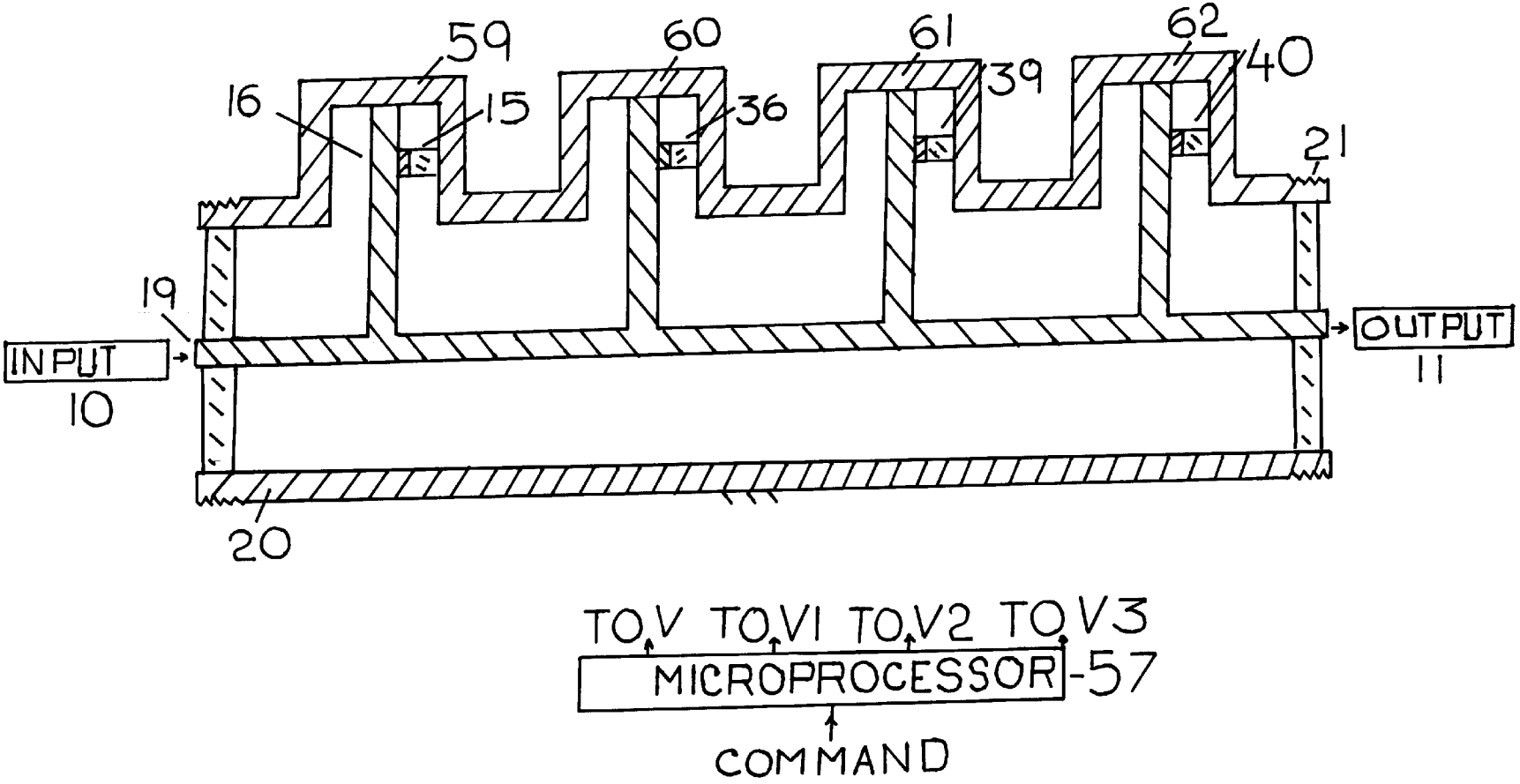
FIG. 13. Longitudinal cross-section through the ferroelectric rods, of a 4 cavity band reject tunable filter.

In FIG. 13 is depicted a 4 cavity band reject filter. The ferroelectric rods, loading the 4 cavities, are 15, 36, 39 and 40. The branch cavities are short circuited at the end, by plates 59, 60, 61 and 62. The biasing and the iris of each cavity are similar to that shown in FIG. 11 and FIG. 12. The bias voltages, applied to the 4 cavities, are V, V1, V2 and V3. Each cavity is calibrated with the resonant frequency versus the applied bias voltage. The data are stored in a memory of the microprocessor 57. When a particular frequency is chosen, the command signal selects the appropriate bias voltage for each of the ferroelectric rods. The separation between the cavities is three quarter wavelengths, at the operating frequency of the tunable filter, and, in another embodiment, an appropriate length. Input is 10 and the output is 11. Element 21 is a threaded section for connecting a connector. The four cavities are tuned to the same frequency when a larger attenuation is required at the rejection frequency. To obtain a broader band reject filter, the cavities are tuned with staggered frequencies.

Figure 14:
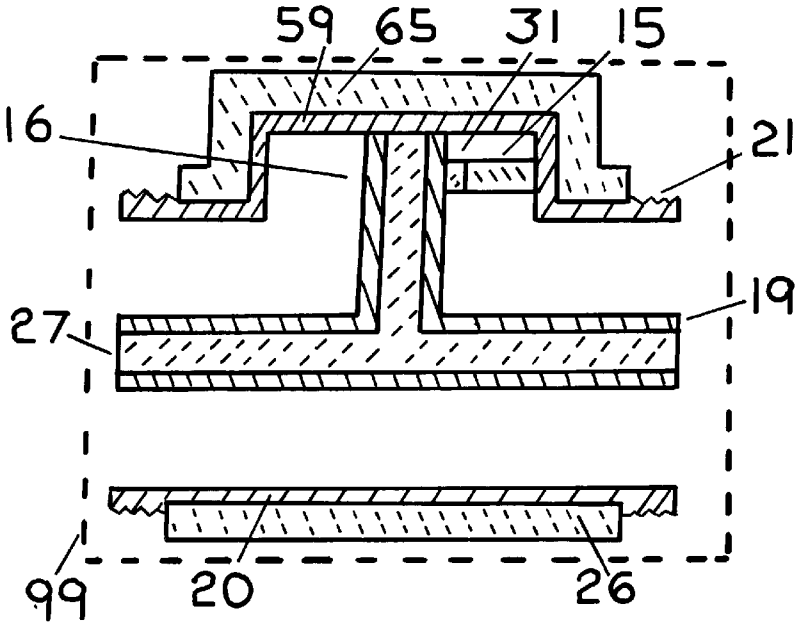
FIG. 14: Longitudinal cross-section, showing the ferroelectric rod, of a single crystal dielectric coaxial band reject tunable filter.
Figure 15:
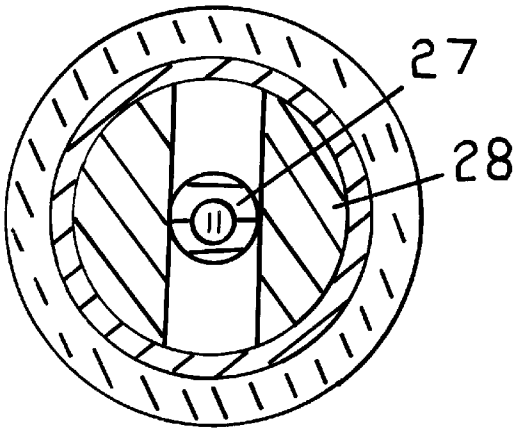
FIG. 15: Longitudinal cross-section, through the iris, of a single crystal dielectric coaxial band reject tunable filter.

In FIG. 14 and FIG. 15 is depicted a single crystal dielectric coaxial band reject tunable filter. The central coaxial conductor 27 is made of a single crystal dielectric material, including sapphire and lanthanum aluminate, the outer conducting surfaces, shown in FIG. 14, of which are deposited with a film 19 of a single crystal high Tc superconductor including YBCO. The outer coaxial conductor 26 is made of a single crystal dielectric material the interior conducting surfaces of which are deposited with a film 20 of a single crystal high Tc superconductor. The branch coaxial 16 is connected to the main coaxial transmission line. The branch coaxial line is short circuited, by a single crystal dielectric plate 65, the inner conducting surfaces 59 of which are deposited with a film of a single crystal high Tc superconductor, at its end. The branch line is loaded with a ferroelectric rod 15. The branch line cavity is coupled to the main transmission line by an iris 28 (see FIG. 15). The iris is made of a single crystal dielectric material the conducting surfaces of which are deposited with a film of single crystal high Tc superconductor. Element 21 is a threaded section for connecting a connector.

The variables in the coaxial filter construction are (1) the diameter of the outer conductor, (2) the diameter of the inner conductor, (3) the type of ferroelectric material, (4) the type of conductor material used for the outer conductor and (5) the type of conductor material used for the inner conductors. The combination of all these variables, more than fifty, are contemplated in this invention.

It should be understood that the foregoing disclosure relates to only typical embodiments of the invention and that numerous modification or alternatives may be made, by those of ordinary skill in the art, therein without departing from the spirit and the scope of the invention as set forth in the appended claims. Different ferroelectrics, ferroelectric liquid crystals (FLC), dielectrics, impedances, high Tc superconductors, number of cavities, diameters of inner and outer coaxial conductors, sizes of irises, types of irises, dielectric filled and air filled coaxial transmission lines are contemplated.

What is claimed is:

1. A band pass tunable filter comprising:

a main coaxial transmission line section comprising an inner conductor and outer concentric conductor;

a first coaxial cavity having respectively first input and first output irises and being connected to and being a part of said main coaxial transmission line;

a first ferroelectric rod characterized by an electric field dependent permittivity and being placed in a center of said first coaxial cavity between said outer conductor and said inner conductor;

a first means, connected with said first ferroelectric rod, to independently apply a bias electric field, using a separate voltage source, to said first ferroelectric rod to change the permittivity thereof and a resonant frequency of said first cavity;

a second coaxial cavity having respectively second input and second output irises and being connected to and being a part of said main coaxial transmission line;

a second ferroelectric rod characterized by said permittivity and being placed in a center of said second coaxial cavity between said outer conductor and said inner conductor;

a second means, connected with said second ferroelectric rod, to independently apply a bias electric field, using a separate voltage source, to said second ferroelectric rod to change the permittivity thereof and a resonant frequency of said second cavity;

a first coaxial transmission line section being a part of said main coaxial transmission line and being connected to and providing a separation, between centers of said first and second coaxial cavities, of typically three quarters of a wavelength long, at an operating frequency of the filter;

third, fourth . . . nth coaxial cavities with corresponding irises and being connected to and being a part of said main coaxial transmission line;

third, fourth . . . nth ferroelectric rods characterized by said permittivity and being respectively placed in centers of each said third, fourth . . . nth coaxial cavities between each said outer conductor and said inner conductor;

third, fourth . . . nth means, connected respectively with said third, fourth . . . nth ferroelectric rods, to independently apply a bias electric field, using separate voltage sources, to said respectively third, fourth . . . nth ferroelectric rods to change the permittivity thereof and a resonant frequency respectively of said third, fourth . . . nth coaxial cavities;

second, third . . . (n−1)th coaxial transmission line sections being a part of said main coaxial transmission line section and providing a respective separation, between the centers of successive adjacent coaxial cavities, of typically three quarters of a wavelength long at an operating frequency of the filter;

all inner surfaces of said outer conductor and outer surfaces of inner conductors being comprised of a single crystal high Tc superconducting material;

an output of a microprocessor connected to each voltage source, to independently control the level of bias voltage to said first, second, third, fourth . . . nth ferroelectric rods; and means, with which said tunable filter being associated with, to keep said coaxial cavity tunable filter at a constant high superconducting temperature appropriately above the Curie temperature.

2. A band pass coaxial cavity tunable ferroelectric filter of claim 1 wherein the single crystal ferroelectric material being a mixture of strontium titanate and lead titanate and the high Tc superconductor being YBCO.

3. A band pass coaxial cavity tunable ferroelectric filter of claim 1 wherein the single crystal ferroelectric material being a mixture of strontium titanate and lead titanate and the high Tc superconductor being TBCCO.

4. A band pass coaxial cavity tunable ferroelectric filter of claim 1:

wherein the single crystal ferroelectric material being $KTa_{1-x}Nb_xO_3$ and the value of x is between 0.005 and 0.7.

5. A band pass coaxial cavity tunable ferroelectric filter of claim 4 wherein the high Tc superconductor being YBCO.

6. A band pass coaxial cavity tunable ferroelectric filter of claim 4 wherein the high Tc superconductor being TBCCO.

7. A band pass tunable filter comprising:

a main coaxial transmission line section comprising an inner conductor being made of said single crystal dielectric having outer surfaces deposited with a film of a single crystal high Tc superconductor and an outer concentric conductor comprised of said single crystal dielectric having interior surfaces which being deposited with a film of a high Tc superconductor;

a first coaxial cavity having respectively first input and first output irises and being connected to and being a part of said main coaxial transmission line;

a first ferroelectric rod characterized by an electric field dependent permittivity and being placed in a center of said first coaxial cavity between said outer conductor and said inner conductor;

a first means, connected with said first ferroelectric rod, to independently apply a bias electric field, using a separate voltage source, to said first ferroelectric rod to change the permittivity thereof and a resonant frequency of said first cavity;

a second coaxial cavity having respectively second input and second output irises and being connected to and being a part of said main coaxial transmission line;

a second ferroelectric rod characterized by said permittivity and being placed in a center of said second coaxial cavity between said outer conductor and said inner conductor;

a second means, connected with said second ferroelectric rod, to independently apply a bias electric field, using a separate voltage source, to said second ferroelectric rod to change the permittivity thereof and a resonant frequency of said second cavity;

a first coaxial transmission line section being a part of said main coaxial transmission line and being connected to and providing a separation, between centers of said first and second coaxial cavities, of typically three quarters of a wavelength long, at an operating frequency of the filter;

third, fourth . . . nth coaxial cavities with corresponding irises and being connected to and being a part of said main coaxial transmission line;

third, fourth . . . nth ferroelectric rods characterized by said permittivity and being respectively placed in centers of each said third, fourth . . . nth coaxial cavities between each said outer conductor and said inner conductor;

third, fourth . . . nth means, connected respectively with said third, fourth . . . nth ferroelectric rods, to independently apply a bias electric field, using separate voltage sources, to said respectively third, fourth . . . nth ferroelectric rods to change the permittivity thereof and a resonant frequency respectively of said third, fourth . . . nth coaxial cavities;

second, third . . . (n−1)th coaxial transmission line sections being a part of said main coaxial transmission line section and providing a respective separation, between the centers of successive adjacent coaxial cavities, of typically three quarters of a wavelength long at an operating frequency of the filter;

an output of a microprocessor connected to each voltage source, to independently control the level of bias voltage to said first, second, third, fourth . . . nth ferroelectric rods; and means, with which said tunable filter being associated with, to keep said coaxial cavity tunable filter at a constant high superconducting temperature appropriately above the Curie temperature.

8. A band pass coaxial cavity tunable ferroelectric filter of claim 7: wherein the single crystal ferroelectric material being a mixture of strontium titanate and lead titanate and the high Tc superconductor being YBCO.

9. A band pass coaxial cavity tunable ferroelectric filter of claim 7:

wherein the single crystal ferroelectric material being a mixture of strontium titanate and lead titanate and the high Tc superconductor being TBCCO.

10. A band pass coaxial cavity tunable ferroelectric filter of claim 7:

wherein the single crystal ferroelectric material being $KTa_{1-x}Nb_xO_3$ and the value of x is between 0.005 and 0.7.

11. A band pass coaxial cavity tunable ferroelectric filter of claim 10 wherein the high Tc superconductor being YBCO.

12. A band pass coaxial cavity tunable ferroelectric filter of claim 10 wherein the high Tc superconductor being TBCCO.

13. A band pass tunable filter comprising:

a main coaxial transmission line section comprising an inner conductor and outer concentric conductor;

a first coaxial cavity having respectively first input and first output irises and being connected to and being a part of said main coaxial transmission line;

a first ferroelectric rod characterized by an electric field dependent permittivity and being placed in a center of said first coaxial cavity between said outer conductor and said inner conductor;

a first means, connected with said first ferroelectric rod, to independently apply a bias electric field, using a separate voltage source, to said first ferroelectric rod to change the permittivity thereof and said resonant frequency of said first cavity;

a second coaxial cavity having respectively second input and second output irises and being connected to and being a part of said main coaxial transmission line;

a second ferroelectric rod characterized by said permittivity and being placed in a center of said second coaxial cavity between said outer conductor and said inner conductor;

a second means, connected with said second ferroelectric rod, to independently apply a bias electric field, using a separate voltage source, to said second ferroelectric rod to change the permittivity thereof and said resonant frequency of said second cavity;

a first coaxial transmission line section being a part of said main coaxial transmission line and being connected to and providing a separation, between centers of said first and second coaxial cavities, of typically three quarters of a wavelength long, at an operating frequency of the filter;

third, fourth . . . nth coaxial cavities with corresponding irises and being connected to and being a part of said main coaxial transmission line;

third, fourth . . . nth ferroelectric rods characterized by said permittivity and being respectively placed in centers of each said third, fourth . . . nth coaxial cavities between each said outer conductor and said inner conductor;

third, fourth . . . nth means, connected respectively with said third, fourth . . . nth ferroelectric rods, to independently apply a bias electric field to said respectively third, fourth . . . nth ferroelectric rods to change the permittivity thereof and a resonant frequency respectively of said third, fourth . . . nth coaxial cavities;

second, third . . . (n−1)th coaxial transmission line sections being a part of said main coaxial transmission line section and providing a respective separation, between the centers of successive adjacent coaxial cavities, of typically three quarters of a wavelength long at an operating frequency of the filter;

an output of a microprocessor connected to each voltage source, to independently control the level of bias voltage to said first, second, third, fourth . . . nth ferroelectric rods; and means, with which said tunable filter being associated with, to keep said coaxial cavity tunable filter at a constant temperature appropriately above the Curie temperature.

14. A band pass coaxial cavity tunable ferroelectric filter of claim 13:

wherein the single crystal ferroelectric material being $KTa_{1-x}Nb_xO_3$ and the value of x is between 0.005 and 0.7.

15. A band pass coaxial cavity tunable ferroelectric filter of claim 13:

wherein the single crystal ferroelectric material being a mixture of strontium titanate and lead titanate.

16. A band reject tunable filter comprising:

a main coaxial transmission line section comprising an inner conductor and outer concentric conductor;

a first branch coaxial transmission line;

inner conductor of said first branch coaxial transmission line being connected to said inner conductor of main coaxial transmission line;

outer conductor of said first branch coaxial transmission line being connected to said outer conductor of main coaxial transmission line;

a first branch coaxial cavity being formed by being short circuited at the end and by placing an iris at the junction with and being separate from said main coaxial transmission line;

a single crystal first ferroelectric rod characterized by an electric field dependent permittivity and being placed in a center of said first branch coaxial cavity between said outer conductor and said inner conductor;

a first means, connected with said single crystal first ferroelectric rod, to independently apply a bias electric field, using a separate voltage source, to said single crystal first ferroelectric rod to change the permittivity thereof and a resonant frequency of said first branch coaxial cavity;

a second branch coaxial transmission line;

inner conductor of said second branch coaxial transmission line being connected to said inner conductor main coaxial transmission line;

outer conductor of said second branch coaxial transmission line being connected to said outer conductor of main coaxial transmission line;

a second branch coaxial cavity being formed by being short circuited at the end and by placing an iris at the junction with and being separate from said main coaxial transmission line;

a first coaxial transmission line section being a part of said main coaxial transmission line and being connected to and providing a separation, between centers of said first and second branch coaxial cavities, of typically three quarters of a wavelength long, at an operating frequency of the filter a single crystal second ferroelectric rod characterized by said permittivity and being placed in a center of said second branch coaxial cavity between said outer conductor and said inner conductor;

a second means, connected with said single crystal second ferroelectric rod, to independently apply a bias electric field, using a separate voltage source, to said single crystal second ferroelectric rod to change the permittivity thereof and a resonant frequency of said second branch coaxial cavity;

third through nth branch coaxial transmission lines;

inner conductors of each said third through nth branch coaxial transmission lines being connected respectively to said inner conductor of main coaxial transmission line;

outer conductors of each said third through nth branch coaxial transmission lines being connected respectively to said outer conductor of main coaxial transmission line;

each third through nth branch coaxial cavities being formed by third through nth branch coaxial transmission lines and being short circuited at the ends and by placing a respective iris at the corresponding junctions with and being separate from said main coaxial transmission line and being separate from one another;

single crystal third through nth ferroelectric rods characterized by said permittivity and being respectively placed in centers of each said third through nth branch coaxial cavities between each said outer conductor and said inner conductor;

second through (n−1)th coaxial transmission line sections being a part of said main coaxial transmission line and being connected to and providing respectively a separation, between centers of said adjacent third through nth branch coaxial cavities, of typically three quarters of a wavelength long, at an operating frequency of the filter third through nth means, connected respectively with said single crystal third through nth ferroelectric rods, to independently apply bias electric fields, using separate voltage sources, each to corresponding said single crystal third through nth ferroelectric rods to change the permittivity thereof and a resonant frequency respectively of said third through nth branch coaxial cavities;

inner surfaces of said outer conductor and outer surfaces of inner conductors being comprised of a single crystal high Tc superconductor material;

a microprocessor connected to each voltage source, to independently control the level of bias voltage to each said first, second, third through nth ferroelectric rods;

said main coaxial transmission line, said branch cavities, said coaxial transmission line sections being connected together producing said tunable band reject filter; and means, with which said tunable filter being associated with, to keep said coaxial cavity tunable filter at a constant high superconducting temperature appropriately above the Curie temperature.

17. A band reject coaxial cavity tunable filter of claim 16: wherein the single crystal ferroelectric material being a mixture of strontium titanate and lead titanate.

18. A band reject coaxial cavity tunable filter of claim 16:

wherein the ferroelectric material being a mixture of strontium titanate and lead titanate and the single crystal high Tc superconductor being YBCO.

19. A band reject coaxial cavity tunable filter of claim 16:

wherein the single crystal ferroelectric material being $KTa_{1-x}Nb_xO_3$ and the value of axis between 0.005 and 0.7.

* * * * *